US009865118B2

(12) United States Patent
Angus

(10) Patent No.: US 9,865,118 B2
(45) Date of Patent: Jan. 9, 2018

(54) CASSETTE REPLENISHMENT

(75) Inventor: Robin Angus, Fife (GB)

(73) Assignee: NCR Corporation, Duluth, GA (US)

( * ) Notice: Subject to any disclaimer, the term of this patent is extended or adjusted under 35 U.S.C. 154(b) by 136 days.

(21) Appl. No.: 13/562,790

(22) Filed: Jul. 31, 2012

(65) Prior Publication Data

US 2014/0037421 A1 Feb. 6, 2014

(51) Int. Cl.
*G07D 11/00* (2006.01)

(52) U.S. Cl.
CPC ..... *G07D 11/0006* (2013.01); *G07D 11/0057* (2013.01)

(58) Field of Classification Search
CPC ..... G07D 2211/00; G07D 13/00; G07D 11/0006; G07D 11/0057; G07D 11/021; G07D 11/0081; B65H 2701/1912
USPC ..... 414/788.1, 788.9, 789, 789.9, 790.3, 414/791.5, 795.7, 796.2, 798.7, 802, 414/331.01, 331.03, 331.08, 331.16; 194/206, 207; 902/8–17; 382/135; 271/180, 181, 145
See application file for complete search history.

(56) References Cited

U.S. PATENT DOCUMENTS 3,396,964 A * 8/1968 Kocourek ..... B65H 3/0808 271/11
3,655,186 A * 4/1972 Bayha ..... 271/180
4,529,119 A * 7/1985 Granzow et al. ..... 232/43.3
4,655,368 A 4/1987 Bateman et al.
4,704,061 A * 11/1987 Peebles ..... G07D 11/0006 414/403
4,884,671 A * 12/1989 Gardellini ..... 194/207
4,913,341 A * 4/1990 Bachman ..... 232/1 D
5,016,546 A * 5/1991 Haueter ..... G07D 11/0096 109/45
5,104,109 A * 4/1992 Kubo ..... B65H 31/06 271/110
5,209,395 A * 5/1993 Zouzoulas et al. ..... 232/15
5,240,368 A * 8/1993 Graef et al. ..... 414/788.9
5,288,066 A * 2/1994 Hain ..... 271/181
5,476,254 A * 12/1995 Golicz ..... B65H 1/025 271/10.04
5,478,185 A * 12/1995 Kranz ..... 414/331.13
5,653,436 A * 8/1997 Zouzoulas ..... G07D 11/0009 271/163
5,735,516 A * 4/1998 Gerlier et al. ..... 270/60
5,829,673 A * 11/1998 Harr, Jr. ..... 232/15
5,871,209 A * 2/1999 Orchard et al. ..... 271/149
(Continued)

FOREIGN PATENT DOCUMENTS

CN 202033834 U 11/2011
CN 102509388 A 6/2012
WO WO 2011/078177 * 6/2011 ..... G07D 9/00

*Primary Examiner* — Anna M Momper
*Assistant Examiner* — Lynn E Schwenning
(74) *Attorney, Agent, or Firm* — Schwegman, Lundberg & Woessner

(57) ABSTRACT

A Currency Cassette Replenishment Terminal (CCRT) and its method of use are disclosed. The CCRT includes a currency cassette support for locating a currency cassette in a loading position, a currency note support comprising at least one loading orifice located in said loading position, and a plunger located on a first side of the loading orifice and movable from a retracted position, through the loading orifice, to an extended position within the currency cassette.

10 Claims, 2 Drawing Sheets

(56) References Cited

U.S. PATENT DOCUMENTS

| | | | | |
|---|---|---|---|---|
| 6,039,164 | A * | 3/2000 | Waters et al. | 194/206 |
| 6,059,090 | A * | 5/2000 | Davis et al. | 194/350 |
| 6,398,000 | B1 * | 6/2002 | Jenrick et al. | 194/200 |
| 6,484,938 | B1 * | 11/2002 | Shepherd | G07D 11/0057 235/381 |
| 6,786,354 | B2 * | 9/2004 | Black | G07D 11/0045 221/56 |
| 7,230,223 | B2 * | 6/2007 | Jespersen et al. | 250/206.1 |
| 7,341,179 | B2 * | 3/2008 | Tocher | G07D 11/0039 235/379 |
| 7,427,063 | B2 * | 9/2008 | Fairweather | B65H 1/025 271/149 |
| 7,497,435 | B2 * | 3/2009 | Chastain | B65H 1/025 271/149 |
| 7,497,436 | B2 * | 3/2009 | Tocher | G07D 11/0012 271/145 |
| 7,850,164 | B2 * | 12/2010 | Ahn | B65H 1/02 109/47 |
| 7,938,245 | B2 | 5/2011 | Jenrick et al. | |
| 8,668,194 | B2 * | 3/2014 | Peters | G07D 11/0012 271/149 |
| 2011/0036731 | A1 * | 2/2011 | Bortz | G07D 11/0006 206/1.5 |
| 2011/0067463 | A1 | 3/2011 | Copestake et al. | |
| 2012/0279173 | A1 * | 11/2012 | Sakoguchi | G07D 11/0081 53/399 |
| 2013/0259637 | A1 * | 10/2013 | Arthur | B65H 1/266 414/816 |

* cited by examiner

CASSETTE REPLENISHMENT

FIELD OF THE INVENTION

The present invention relates to a method and apparatus for cassette replenishment. In particular, but not exclusively, the present invention relates to a currency cassette replenisher and its method of automated use.

BACKGROUND TO THE INVENTION

Media cassettes are used to store media in sheet form for automated picking and dispensing in many types of self-service terminal (SST). For example, one particular type of media cassette is a currency cassette which may be used in Automated Teller Machines (ATMs). An ATM may include multiple media cassettes in the form of currency cassettes with each cassette storing currency notes having a respective value.

A typical currency cassette stores thousands of currency notes (also referred to as banknotes) in a neat array. This neat array of banknotes is urged towards a picking area of the currency cassette by a sprung plate (referred to as a pusher plate) which ensures that the neat array in the currency cassette is maintained in contact with the picking area as currency notes are removed from the cassette one-by-one.

Conventionally, to replenish the currency cassette with currency notes, a lid of the currency cassette is removed, and then the sprung plate is retracted and an array of new banknotes is then placed between the retracted sprung plate and the picking area. It is quite difficult for one person to retract the sprung plate and insert the array of new banknotes whilst holding the sprung plate in its retracted position. This can cause the inserted banknotes to be incorrectly loaded, which may lead to problems in picking these banknotes from the currency cassette. It is also time consuming to remove the lid of the currency cassette.

The recent currency industry trend associated with ATMs, which is for closed cycle cash management, is resulting in customers looking for ways to load and move cassettes between equipment without an operator touching the currency notes. This would reduce the chance of operator error and additionally, would obviate the need for extra security personnel to monitor cash transfers into the currency cassette. Until now, a suitable solution to this long felt need has been lacking.

SUMMARY OF THE INVENTION

It is an aim of the present invention to at least partly mitigate the above-mentioned problems.

It is an aim of certain embodiments of the present invention to support a closed cash cycle environment.

It is an aim of certain embodiments of the present invention to provide a method and apparatus for loading currency notes into a currency cassette which prevents the need for an authorized operator to touch the cassette, sprung plate and currency notes during a loading process.

It is an aim of certain embodiments of the present invention to provide a method of loading legacy currency cassettes whereby a re-design of currently in use currency cassettes is not required to facilitate the automation of a loading process.

According to a first aspect of the present invention there is provided a currency cassette replenishment terminal (CCRT) for loading at least one currency note in a currency cassette, comprising:

- a currency cassette support for locating a currency cassette in a loading position;
- a currency note support comprising at least one loading orifice located at a position corresponding to a pick orifice of a currency cassette located in said loading position; and
- a plunger located on a first side of the loading orifice and movable from a retracted position, through the loading orifice, to an extended position within the currency cassette.

Aptly, the pick orifice and the loading orifice are substantially similar in size and shape and are arranged in a face-to-face juxtaposed relationship when the cassette is in the loading position.

Aptly, the currency note support comprises a pair of spaced apart side walls, one side wall defining the loading orifice and a remaining side wall defining a drive-through aperture, and a base comprising a support surface that supports one or more currency notes between the side walls.

Aptly, the currency note support defines an open mouth region between the spaced apart side walls, wherein the open mouth region receives one or more currency notes from a transport pathway.

Aptly, the CCRT further comprises a ballistic stacker between the transport pathway and said currency note support that locates a stack of currency notes in the currency note support.

Aptly, the plunger comprises a plunger body defining an abutment surface having a smaller surface area than either the driver-through aperture or the loading orifice, and that is located spaced apart from the loading orifice to allow a currency note or bunch of notes to be located at the loading orifice when the plunger is retracted.

Aptly, the CCRT further comprises a drive module that selectively moves the plunger between the retracted position and the extended position to locate the plunger in a respective out or in position with respect to an internal space in the currency cassette.

Aptly, the drive module comprises a motor or a solenoid, or the like.

Aptly, when the plunger is moving to the extended position, the plunger urges a currency note or bunch of notes from a position at the loading orifice of the currency note support into the cassette against a pusher plate of the cassette or at least one currency note supported in the cassette by the pusher plate.

Aptly, the currency cassette support comprises a cassette support surface and a plurality of elongate tines that locate in respective channels of a currency cassette located in the loading position to thereby open a pick orifice of the cassette.

Aptly, the elongate tines are arranged to open a sliding shutter in the currency cassette when located in said channels.

Optionally, the currency cassette support includes an inclined support surface for locating a currency cassette at an angle to horizontal. The inclined support surface may support a cassette at an angle within the range of ten to seventy degrees. The pusher plate may be urged by a spring that is not capable of operating at too large an angle to the horizontal, so the angle of the inclined support surface may be within the range of ten to forty degrees, or fifteen to thirty degrees.

According to a second aspect of the present invention there is provided a method of loading at least one currency note in a currency cassette, comprising the steps of:

supporting at least one currency note at an loading orifice of a currency note support, said loading orifice being located at a position corresponding to a pick orifice of a currency cassette; and extending a plunger through the loading orifice and said pick orifice to urge at least one currency note supported at the loading orifice into a stacked configuration inside the currency cassette.

Aptly, the method further comprises the steps of:

retracting the plunger to a retracted position;

transporting a currency note or a bunch of currency notes to the loading orifice; and repeating the extending step to urge the transported currency note or bunch of currency notes into a stacked configuration inside the currency cassette.

Aptly, the method further comprises the steps of providing the currency notes from a secure zone of control and locating said notes at the loading orifice and subsequently in the cassette automatically.

Optionally, the method further comprises the steps of: receiving currency notes from a note interface, validating the received currency notes, and transporting the received currency notes to the loading orifice.

Aptly, the method further comprises the steps of, as one or more currency notes are located in the cassette, supporting an incoming currency note or bunch of notes via a biased urging plate member of the cassette.

According to a third aspect of the present invention there is provided a method of securely locating currency notes in a currency cassette, comprising the steps of:

automatically locating and subsequently plunging currency notes through a pick orifice of a currency cassette.

According to a fourth aspect of the present invention there is provided a method of securely locating media items in a media cassette, comprising the steps of:

automatically locating and subsequently plunging media items through a pick orifice of a media cassette.

According to a fifth aspect of the present invention there is provided a media cassette replenishment terminal for loading at least one media item in a media cassette, comprising:

a media cassette support for locating a media cassette in a loading position;

a media item support comprising at least one loading orifice located at a position corresponding to a pick orifice of a media cassette located in said loading position; and a plunger located on a first side of the loading orifice and movable from a retracted position, through the loading orifice, to an extended position within the media cassette.

Certain embodiments of the present invention make use of the spring loaded nature of currency cassettes and allow legacy cassette designs to be loaded without substantive design changes to the cassettes themselves.

Certain embodiments of the present invention provide the advantage that currency cassettes may be loaded/replenished with items of media in an automated way.

BRIEF DESCRIPTION OF DRAWINGS

Embodiments of the present invention will now be described hereinafter, by way of example only, with reference to the accompanying drawings in which.

DESCRIPTION OF EMBODIMENTS

Figure 1:
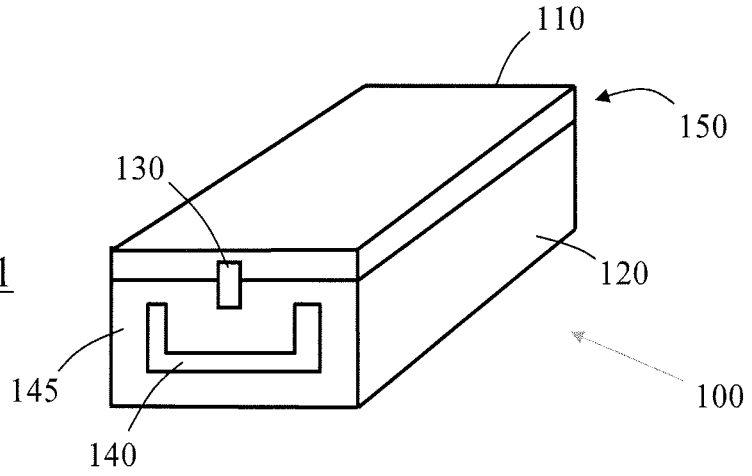
FIG. 1 is a schematic perspective diagram of a media cassette in the form of a currency cassette.

In the drawings like reference numerals refer to like parts.

FIG. 1 illustrates a media cassette 100 in the form of a polycarbonate currency cassette for storing currency notes (sometimes referred to as banknotes). The cassette 100 shown in FIG. 1 has a lid 110 secured to a body 120 by a latch 130. The cassette body 120 has a handle 140 at a first end 145 (referred to as the "handle end") which is spaced apart from a further end 150 (referred to as a "picking end") of the cassette 100. The handle end 145 is also referred to as a "non-picking end". A closed pick window (shown more clearly in FIG. 2) is located at the picking end 150.

Figure 2:
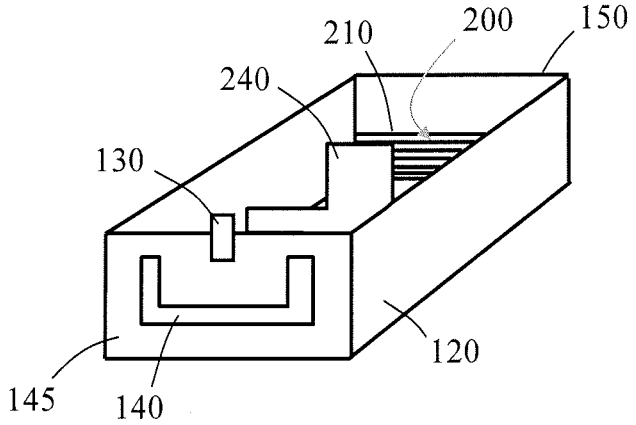
FIG. 2 illustrates a schematic view of a body portion of the currency cassette shown in FIG. 1 with the lid removed.

As illustrated in FIG. 2, which illustrates the cassette 100 shown in FIG. 1 with the lid 110 removed, the picking end 150 includes a roller shutter 200 which covers a pick window 210 (also referred to as a pick orifice) when the currency cassette 100 is being transported. When the currency cassette 100 is inserted into a currency dispenser (not shown), for example, in an Automated Teller Machine (ATM), tines (not shown) in the currency dispenser (not shown) engage with blocks (not shown) mounted in channels (not shown in FIG. 2) defined in the body 120 to raise the roller shutter 200 and open the pick window 210. FIG. 2 also illustrates how a pusher plate 240 is located inside the currency cassette 100 to help urge a stack of currency notes towards the picking end 150 of the currency cassette 100.

Figure 3:
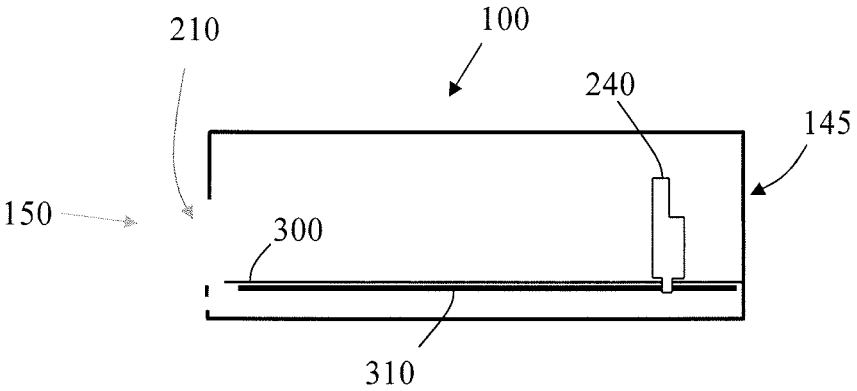
FIG. 3 is a simplified sectional side view of the body portion of the cassette shown in FIG. 1 and FIG. 2.

FIG. 3 helps illustrate how the cassette 100 includes a floor 300 beneath which a central rail 310 is provided that extends longitudinally along the length of the cassette 100 from the non-picking end 145 towards the picking end 150. The biased pusher plate 240 is slidably mounted on the central rail 310 and is coupled thereto by a ratchet mechanism (not shown). The pusher plate 240 is biased towards the picking end 150 by a coil spring (not shown) located beneath the floor 300. The pusher plate 240 pushes a stack (also referred to as an array) of currency notes thereby urging them towards the pick window 210 so that when the pick window 210 is open, currency notes can be picked through the pick window 210 by a currency dispenser (not shown).

Figure 4:
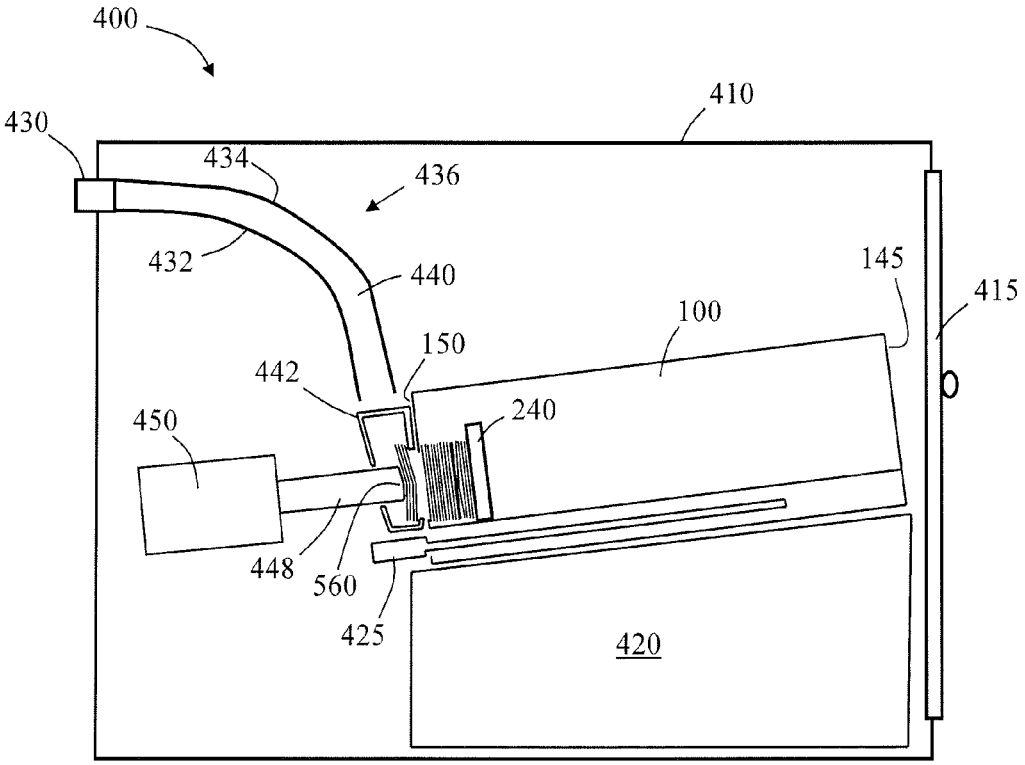
FIG. 4 illustrates a currency cassette replenishment terminal according to one embodiment of the present invention, which can be used to replenish currency notes in a currency cassette of the type shown in FIGS. 1 to 3.

FIG. 4 illustrates a currency cassette replenishment terminal (CCRT) 400 according to one embodiment of the present invention. The CCRT 400 provides a secure system for loading currency notes in containers, such as the currency cassette 100 illustrated. The CCRT 400 is a terminal having a rigid housing 410 to which access is only available to authorized personnel via an access door 415. The door 415 is illustrated in a closed position in FIG. 4 but it will be understood that the door 415 can be opened and securely locked whenever currency notes are loaded into an empty or partially empty currency cassette 100. The door 415 is opened to put empty (or nearly empty) cassettes 100 in the terminal 400 to be replenished or to remove replenished cassettes 100.

When the door 415 is opened, an authorized person can slide a currency cassette 100 into a loading position on a currency cassette support 420. Other mechanisms for locating currency cassettes can of course be utilized according to certain other embodiments of the present invention. As a person slides the cassette 100 onto the currency cassette support 420, a pair of tines 425 secured to the support 420 extend into the cassette 100 and open the shutter 200 (not shown in FIG. 4) to reveal the pick window 210 aperture. The support 420 locates and supports a currency cassette 100 in a non-vertical orientation, with the picking end 150 lower than the handle end 145. This ensures that the pusher plate 240 is assisted by gravity in urging loaded currency notes towards the pick window 210. In this embodiment, the support 420 locates and supports a storage currency cassette 100 at an angle of approximately twenty five degrees to the horizontal. In certain other embodiments, the platform 420 may support and locate a currency cassette at an angle between approximately fifteen to sixty degrees to the horizontal.

The CCRT 400 also includes a currency note insertion aperture 430 which allows bunches of currency notes to be introduced to the terminal 400 by authorized personnel. The currency note insertion aperture 430 can be a slot-type or pocket-type of input mechanism. A bunch of notes is inserted into the insertion aperture 430 by a replenisher (which may be a human being, or a dispensing terminal that is coupled to the CCRT 400). The bunch of currency notes is then clamped between opposing belts 432,434 of a bunch note transport 436, and the bunch of currency notes is then transported along a transport pathway 440 and driven downwards into a currency note support 442 in the form of a pre-stage holder.

Figure 5:
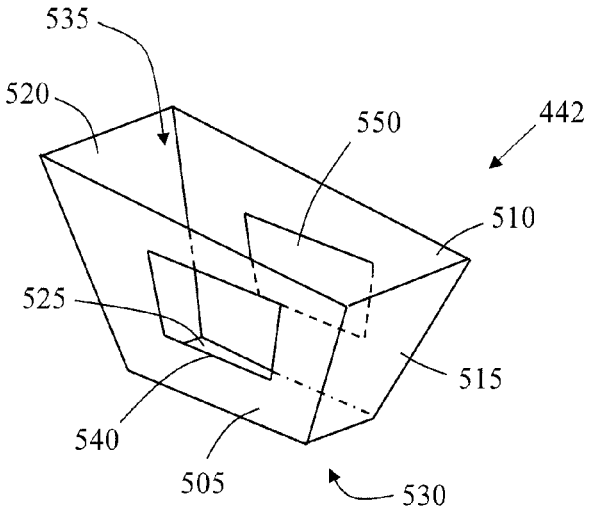
FIG. 5 illustrates a part (a currency note support) of the terminal of FIG. 4 in more detail.

The pre-stage holder 442 is illustrated in more detail in FIG. 5 and includes a pair of drive-through apertures 540, 550 in registration with a mechanical ram (or plunger) 448, driven by a drive system 450, and the pick window 210. The drive-through aperture 540 closest to the mechanical ram 448 is referred to as the ram side drive-through aperture. The drive-through aperture 550 closest to the pick window 210 is referred to as the pick side drive-through aperture (or the loading orifice).

As illustrated in FIG. 5, the pre-stage holder 442 includes tapered, spaced apart side walls 505, 510, and is dimensioned to accommodate a bunch of notes and maintain the bunch of notes as a neat array in preparation for loading into the currency cassette 100. The side walls 505, 510 are spaced apart by tapered edge walls 515, 520 and are closed by a base 525 at one end 530. The pre-stage holder 442 defines an open end 535 opposite the base 525. The open end 535 is referred to as an open mouth region. Currency notes can be introduced from the bunch note transport 436, through this open mouth region 535, and into the pre-stage holder 442. The side wall 505 that faces the plunger 448 defines the ram side drive-through aperture 540. The side wall 510 that faces the cassette 100 (when the cassette 100 is mounted in the CCRT 400) defines the pick side drive-through aperture 550 (the loading orifice 550). The pre-stage holder 442 is an example of a currency note support that supports one or more notes at a desired location ready to be automatically plunged into the cassette 100.

The drive-through apertures 540, 550 are smaller than the area of the smallest note to be loaded into the currency cassette 100, but large enough for a currency note to be pushed through the pick side drive-through aperture 550 during a replenishment operation. In certain embodiments, the ram side drive-through aperture 540 may be smaller than the pick side drive-through aperture 550.

In operation, the mechanical ram 448 is activated and extends linearly through the ram side drive-through aperture 540, an abutment surface 560 (see FIG. 4) thereof engages with the bunch of notes located within the pre-stage holder 442, and then drives the bunch of notes through the pick side drive-through aperture 550 and into the currency cassette 100.

When the mechanical ram 448 is retracted, the bunch of currency notes remains in the cassette 100 because the pick window 210 is smaller than each currency note, so the picking end 150 prevents the currency notes from exiting the currency cassette 100.

This embodiment thus provides a sequence of "stuffing" currency notes into a currency cassette 100 to replenish the cassette on a bunch by bunch basis.

The sequence includes locating the currency cassette 100 in a loading position, at a loading node, with a shutter being opened in the cassette to reveal a pick area via a standard key plate. A currency note or bunch of notes is transported to a holder 442. A currency note is in this position parked so that it is aligned to the note stack in the cassette. A plunger 448 (or ram) which may also be referred to as a stuffer "shoe" is driven downwards, pushing the centre of the note/s through an opening 550 in the holder 442 and down against the face of the notes already present in the cassette (or, if the cassette is empty, against the pusher plate). The shoe continues downwards, accommodated by the reactive movement of the spring loaded pusher plate until the edges of the note flip around the edges of the slot in the support and the front face of the cassette. The note is thus secured in the stack in the cassette 100. The shoe may thereafter be retracted to clear the transport for the next note or bunch.

Certain embodiments of the present invention may releasably secure a currency note to a stuffer shoe/plunger using one or more negative pressure sucker elements. This may help align the incoming currency note and reduce the risk of loading failure or skewing incoming currency notes.

In other embodiments, the pre-stage holder 442 may include one or more releasable clamps to clamp a bunch of notes in place prior to the plunger 448 engaging with the bunch of notes. When the plunger 448 engages with the bunch of notes, the clamps are released to allow the bunch to be transferred to the cassette 100.

In other embodiments, the transport from the currency note insertion aperture 430 to the currency note support 442 may not terminate in a vertical (or near vertical) drop. In such embodiments, a ballistic stacker may be used to ensure that the currency notes are correctly delivered into the currency note support 442.

In other embodiments, the pre-stage holder may be located in a non-vertical orientation (for example, generally horizontally) to facilitate transfer of a bunch of notes to the pre-stage holder. The pre-stage holder may then pivot from the non-vertical orientation into a vertical orientation. Loading the bunch of notes from the pre-stage holder into the currency cassette would then occur by extending and then retracting the plunger 148 as described in the above embodiment.

In other embodiments, a media cassette other than a currency cassette may be replenished. For example, a media cassette containing tickets or coupons may be replenished.

Throughout the description and claims of this specification, the words "comprise" and "contain" and variations of them mean "including but not limited to" and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of the features and/or steps are mutually exclusive. The invention is not restricted to any details of any foregoing embodiments. The invention extends to any novel one, or novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

The invention claimed is:

1. A currency cassette replenishment terminal (CCRT) for loading at least one currency note in a currency cassette, comprising:

a currency cassette support for locating and supporting a currency cassette in a non-vertical loading position;

opposing belts adapted to clamp a bunch of currency notes between the opposing belts for transport along a pathway to a currency note support;

the currency note support containing the bunch and comprising at least one loading orifice located at a position corresponding to a pick orifice of a currency cassette located in said loading position which is opposite a handle end of the currency cassette having a handle for loading and removing the currency cassette from the CCRT;

a plunger located on a first side of the loading orifice and movable from a retracted position, through the loading orifice to an intermediary position engaging the bunch in the currency note support, and to an extended position within the currency cassette linearly and at an angle between approximately fifteen to sixty degrees to the horizontal forcing the bunch into the currency cassette through a pick window of the currency cassette;

a pusher plate, wherein when the plunger is moving to the extended position the plunger urges the bunch of notes from a position at the loading orifice of the currency note support into the currency cassette against the pusher plate of the currency cassette or the bunch supported in the cassette by the pusher plate;

a central rail situated beneath a floor of the currency cassette that extends longitudinally along a length of the floor, wherein the pusher plate is slidably mounted on the central rail, and the pusher plate biased towards the pick orifice; and wherein the currency note support includes tapered and spaced apart side walls and dimensioned to accommodate the bunch of notes and maintain the bunch of notes as a neat array in preparation for loading the bunch into the currency cassette, wherein the currency note support including a base and an open mouth region opposite the base to receive the bunch of notes into the currency note support from a transport pathway, the side walls situated to face the plunger, a first side wall includes a first aperture defining the pick orifice through which the plunger enters the currency note support, the second side wall includes a second aperture defining the loading orifice into the currency cassette, wherein the first aperture is smaller in area than the second aperture.

2. The CCRT as claimed in claim 1, further comprising:

the pick orifice and the loading orifice are arranged in a face-to-face juxtaposed relationship when the cassette is in the loading position.

3. The CCRT as claimed in claim 1, further comprising:

a drive module that selectively moves the plunger between the retracted position and the extended position to locate the plunger in a respective out or in position with respect to an internal space in the currency cassette.

4. The CCRT as claimed in claim 1, further comprising:

the currency cassette support comprises a cassette support surface and a plurality of elongate tines that locate in respective channels of a currency cassette located in the loading position to thereby open a pick orifice of the cassette.

5. The CCRT as claimed in claim 4, further comprising:

the elongate tines are arranged to open a sliding shutter in the currency cassette when located in said channels.

6. A method of loading at least one currency note in a currency cassette, comprising the steps of:

transporting a bunch of currency notes along a pathway by clamping opposing belts between the bunch for delivery along the pathway and into an open mouth region of a currency note support;

supporting the bunch at a loading orifice of the currency note support, said loading orifice being located at a position corresponding to a pick orifice of a currency cassette and said loading orifice is in a face-to-face juxtaposed relationship with the pick orifice, and wherein the pick orifice is smaller in area than the loading orifice;

extending a plunger through the pick orifice of the currency note support and the loading orifice against the bunch at an angle of approximately between fifteen to sixty degrees to the horizontal to urge the bunch into a stacked configuration inside the currency cassette; and biasing the bunch towards the pick orifice by a pusher plate slidably attached to a central rail that extends longitudinally along a length of a floor of the currency cassette, wherein the central rail is situated beneath the floor.

7. The method as claimed in claim 6, further comprising the steps of:

retracting the plunger to a retracted position;

transporting the bunch of currency notes to the loading orifice; and repeating the extending step to urge the transported bunch of currency notes into a stacked configuration inside the currency cassette.

8. The method as claimed in claim 7, further comprising the steps of:

providing the bunch of currency notes from a secure zone of control and locating said notes at the loading orifice and subsequently in the cassette automatically.

9. The method as claimed in claim 6, further comprising the steps of:

as the bunch of currency notes are being located in the cassette, supporting the bunch of notes via a biased urging plate member of the cassette.

10. A method of securely locating media items in a media cassette, comprising the steps of:

automatically locating a bunch of media items in a load position at a loading node;

transporting the bunch of media items by clamping the bunch of media items between opposing belts for transport along a pathway;

plunging, via a plunger, the bunch of media items at an angle of approximately between fifteen to sixty degrees to the horizontal through a currency note support beginning at a pick orifice and ending at a loading orifice, wherein the pick orifice is smaller in area than the loading orifice; and biasing the bunch of media items towards the pick orifice by a pusher plate slidably attached to a central rail that extends longitudinally along a length of a floor of the media cassette, wherein the central rail is situated beneath the floor.

* * * * *